US009315877B2

(12) United States Patent
Torisu et al.

(10) Patent No.: US 9,315,877 B2
(45) Date of Patent: Apr. 19, 2016

(54) STEEL SHEET FOR BOTTOM COVERS OF AEROSOL CANS AND METHOD FOR PRODUCING SAME

(75) Inventors: Keiichiro Torisu, Tokyo (JP); Seiichi Tanaka, Tokyo (JP); Hirokazu Yokoya, Tokyo (JP); Jyunichi Matsunaga, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 3 days.

(21) Appl. No.: 13/991,199

(22) PCT Filed: Dec. 5, 2011

(86) PCT No.: PCT/JP2011/078052

§ 371 (c)(1), (2), (4) Date: Jun. 3, 2013

(87) PCT Pub. No.: WO2012/077628

PCT Pub. Date: Jun. 14, 2012

(65) Prior Publication Data

US 2013/0248054 A1 Sep. 26, 2013

(30) Foreign Application Priority Data

Dec. 6, 2010 (JP) ..... 2010-271944

(51) Int. Cl.
*C21D 8/02* (2006.01)
*C21D 8/04* (2006.01)
(Continued)

(52) U.S. Cl.
CPC ..... *C21D 8/0263* (2013.01); *C21D 8/04* (2013.01); *C21D 8/0405* (2013.01);
(Continued)

(58) Field of Classification Search
CPC ..... C21D 8/02; C22C 38/00; C22C 38/02; C22C 38/04; C22C 38/06
USPC ..... 148/505, 328
See application file for complete search history.

(56) References Cited

U.S. PATENT DOCUMENTS

2003/0188811 A1* 10/2003 Kami et al. ..... 148/603
2009/0250147 A1 10/2009 Nishida et al.
(Continued)

FOREIGN PATENT DOCUMENTS

CN 1114113 A 12/1995
CN 1399001 A 2/2003
(Continued)

OTHER PUBLICATIONS

International Search Report for PCT/JP/2011/078052 dated Feb. 28, 2012.
(Continued)

*Primary Examiner* — Jie Yang
(74) *Attorney, Agent, or Firm* — Birch, Stewart, Kolasch & Birch, LLP

(57) ABSTRACT

A steel sheet for bottom covers of aerosol cans includes, as chemical composition, C: 0.025 to 0.065 mass %, Mn: 0.10 to 0.28 mass %, P: 0.005 to 0.03 mass %, Al: 0.01 to 0.04 mass %, N: 0.0075 to 0.013 mass %, Si: limited to 0.05 mass % or less, S: limited to 0.009 mass % or less, and balance consisting of Fe and unavoidable impurities, wherein yield point YP in rolling direction after aging treatment is in range of 460 to 540 MPa, total elongation in the rolling direction after the aging treatment is 15% or more, yield point elongation $EL_{YP}$ in the rolling direction after the aging treatment is 6% or less, and sheet thickness t in unit of mm, the yield point YP in unit of MPa in the rolling direction after the aging treatment, and the yield point elongation $EL_{YP}$ in unit of % in the rolling direction after the aging treatment satisfy $130 \leq t \times YP \times (1 - EL_{YP}/100)$.

11 Claims, 2 Drawing Sheets

(51) Int. Cl.

| | |
|---|---|
| ***C21D 9/46*** | (2006.01) |
| ***C21D 9/48*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| *B65D 83/38* | (2006.01) |

(52) U.S. Cl.

CPC ..... *C21D 8/0447* (2013.01); *C21D 9/46* (2013.01); *C21D 9/48* (2013.01); *C22C 38/001* (2013.01); *C22C 38/02* (2013.01); *C22C 38/04* (2013.01); *C22C 38/06* (2013.01); *B65D 83/38* (2013.01); *C21D 8/0226* (2013.01)

(56) References Cited

U.S. PATENT DOCUMENTS

| | | | | |
|---|---|---|---|---|
| 2010/0116832 | A1* | 5/2010 | Nishihara et al. ..... | 220/669 |
| 2011/0076177 | A1 | 3/2011 | Aratani et al. | |

FOREIGN PATENT DOCUMENTS

| | | | |
|---|---|---|---|
| EP | 0 556 834 | A2 | 8/1993 |
| EP | 1 741 800 | A1 | 1/2007 |
| EP | 2 009 130 | A1 | 12/2008 |
| EP | 2 103 703 | A1 | 9/2009 |
| JP | 10-72640 | A | 3/1998 |
| JP | 2008-208399 | A | 9/2008 |
| JP | 2009-7607 | A | 1/2009 |
| JP | 2009-263788 | A | 11/2009 |
| JP | 2009-263789 | A | 11/2009 |
| JP | 2010-43349 | A | 2/2010 |
| WO | WO 2008/018531 | A1 | 2/2008 |

OTHER PUBLICATIONS

Notice of Resasons for Rejection mailed Jul. 3, 2012 for JP2012-516239.

Chinese Office Action dated Jan. 6, 2014 for Chinese Application No. 201180058396.X with partial English translation.

Extended European Search Report dated Jun. 23, 2014, for European Application No. 11847252.1.

* cited by examiner

STEEL SHEET FOR BOTTOM COVERS OF AEROSOL CANS AND METHOD FOR PRODUCING SAME

TECHNICAL FIELD

The present invention relates to a steel sheet for bottom covers of aerosol cans and a method for producing the same.

Priority is claimed on Japanese Patent Application No. 2010-271944, filed Dec. 6, 2010, the content of which is incorporated herein by reference.

BACKGROUND ART

Aerosol cans generally have a structure in which the content is sprayed outside the can by using the internal pressure. As a material of the can, a steel sheet is frequently used such that the can endures the internal pressure. Moreover, the aerosol can includes a container constituted with three members including a can body part, a mountain cap, and a bottom cover. The material of the members is selected, or the shape thereof is designed, such that the members endure the internal pressure.

Among the members, the bottom cover is prepared in a manner in which a steel sheet is punched in a circular shape, and then the circular steel sheet is molded into a dome shape mainly by press forming. The bottom cover is attached to the can body part by seaming. The convexity of the dome shape of the bottom cover is installed to protrude toward the inside of the can such that the bottom cover is attached to the can body part, whereby the bottom cover plays a role of dispersing the internal pressure and maintaining strength of the can.

For the materials for the bottom cover of an aerosol can that is provided for the above use, 4 types of mechanical characteristics including pressure resistance, shape fixability, airtightness, and stretcher-strain resistance (hereinafter, stretcher-strain will be described as St-St) are required.

Among the mechanical characteristics, the pressure resistance of a steel sheet is specified mainly by yield point (YP). As a technique for improving the pressure resistance, a method (solid solution strengthening) of making a solid solution remain in steel, a method (work strengthening) of introducing dislocation into steel by temper rolling (hereinafter, abbreviated to TR in some cases), or the like is mainly used. In the process of the related art in which C and N are added in an appropriate amount to steel so as to secure a solid solution, and then general TR of a rolling ratio of about 1% is performed, YP is 400 to 450 MPa. On the other hand, in a so-called 2CR process (two times of cold rolling) in which TR is performed at a rolling ratio of 20 to 30% by using a lubricant, YP of the material can be reliably increased to 500 MPa or higher. However, the high YP is obtained by work strengthening, and moving dislocation cannot be newly introduced into the material. Accordingly, total elongation of the material is only several %.

In view of the shape fixability and airtightness, a steel sheet having excellent total elongation is preferable, and accordingly, it is difficult to make the shape fixability and airtightness compatible with a high degree of pressure resistance. However, so far, even if a relatively soft steel sheet of which the temper degree reaches up to T-5 level specified by JIS G 3303 is used as a bottom cover of an aerosol can, a high internal pressure which may cause a problem in the pressure resistance is rarely applied to the aerosol can. Therefore, improvement of the steel sheet has been rarely required. Moreover, even if St-St occurs slightly in a steel sheet, the St-St is regarded just as a problem of the exterior, so there has been no steel sheet specially designed as a bottom cover of an aerosol can. Further, there has been no steel sheet for bottom covers of aerosol cans that is devised such that the steel sheet is soft at the time of press forming or seaming and exhibits increased strength after being made into a can.

RELATED ART DOCUMENTS

Patent Documents

[Patent Document 1] Japanese Unexamined Patent Application, First Publication No. 2010-043349

[Patent Document 2] Japanese Unexamined Patent Application, First Publication No. 2009-007607

SUMMARY OF INVENTION

Technical Problem

However, in recent years, as the content of aerosol cans has been increasingly diversified, a need for materials of the bottom cover that can endure higher internal pressure arises strongly. High Pressure Gas Safety Act stipulates that an aerosol can needs to have pressure resistance by which the can is not burst at an internal pressure of 15 kgf/cm$^2$. Particularly, since the internal pressure is high in dusters or cleaners, a pressure resistance of 16 kgf/cm$^2$ or higher and desirably 18 kgf/cm$^2$ or higher, which exceeds the current standard, is required for can makers. When the material is hardened to satisfy the requirement, not only the shape fixability deteriorates during the press forming as described above, but also a problem that the airtightness as the lifeblood of an aerosol can deteriorates due to gaps or creases formed when the bottom cover is seamed to the can body part arises.

As a technique used so far, there is a method of using a steel sheet for high strength containers disclosed in, for example, Patent Document 1. However, total elongation of the steel sheet is quite insufficient, and the steel sheet is inferior for being made into the bottom cover of an aerosol can. In addition, in Patent Document 1, after annealing, overaging treatment is performed at a high temperature. Accordingly, the amount of a solid soluted N required in the present invention is not obtained, and a sufficient effect of strain aging is not obtained. Moreover, though Patent Document 2 discloses a DR steel sheet having total elongation of 10% or a higher, the value of the total elongation is insufficient for solving the shape fixability or airtightness.

In addition, St-St caused during press forming that was regarded just as a problem of the exterior in the related art has become a factor that influences the strength of the aerosol can as the internal pressure increases. That is, due to St-St, an uneven portion is formed in the convexity of the dome shape of the bottom cover, and stress concentration occurs, whereby deformation or fracture of the bottom cover easily occurs in some cases. Particularly, deformation called flower dome having a regular petal shape causes a problem for which the pressure resistance of the bottom cover deteriorates markedly.

In order to solve the problems, the sheet thickness of the material of the T-5 level of the related art was increased to maintain the pressure resistance. However, in view of the can cost, gauge reduction is strongly required, and a fundamental countermeasure against St-St has not been found. Accordingly, there is a demand for a steel sheet for bottom covers of aerosol cans that is on a satisfactory level in terms of all of the pressure resistance, shape fixability, airtightness, and St-St resistance.

The present invention has been made in consideration of the above circumstances, and an object thereof is to provide a steel sheet for bottom covers of aerosol cans that is preferably used for the bottom covers of aerosol cans having a high internal pressure, has a high strength and less stretcher-strain, and exhibits excellent workability when being attached to the can body part by seaming, and a method for producing the same.

Solution to Problem

An aspect of the present invention is as follows.

(1) A steel sheet for a bottom cover of an aerosol can according to an aspect of the present invention includes, as a chemical composition, C: 0.025 to 0.065 mass %, Mn: 0.10 to 0.28 mass %, P: 0.005 to 0.03 mass %, Al: 0.01 to 0.04 mass %, N: 0.0075 to 0.013 mass %, Si: limited to 0.05 mass % or less, S: limited to 0.009 mass % or less, and a balance consisting of Fe and unavoidable impurities, wherein a yield point YP in a rolling direction after an aging treatment is in a range of 460 to 540 MPa, a total elongation in the rolling direction after the aging treatment is 15% or more, a yield point elongation $EL_{YP}$ in the rolling direction after the aging treatment is 6% or less, and a sheet thickness t in a unit of mm, the yield point YP in a unit of MPa in the rolling direction after the aging treatment, and the yield point elongation $EL_{YP}$ in a unit of % in the rolling direction after the aging treatment satisfy a following (Formula 1).

$$130 \leq t \times YP \times (1 - EL_{YP}/100) \quad \text{(Formula 1)}$$

(2) In the steel sheet for the bottom cover of the aerosol can according to (1), an amount of a solid soluted N may be 0.004 mass % or more.

(3) In the steel sheet for the bottom cover of the aerosol can according to (2), the amount of the solid soluted N may be 0.006 mass % or more.

(4) A method for producing a steel sheet for a bottom cover of an aerosol can according to an aspect of the present invention includes: hot rolling a steel including, as a chemical composition, C: 0.025 to 0.065 mass %, Mn: 0.10 to 0.28 mass %, P: 0.005 to 0.03 mass %, Al: 0.01 to 0.04 mass %, N: 0.0075 to 0.013 mass %, Si: limited to 0.05 mass % or less, S: limited to 0.009 mass % or less, and a balance consisting of Fe and unavoidable impurities, at a finishing temperature equal to or higher than an Ar3 transformation point; coiling the steel at a temperature equal to or lower than 600° C.; pickling, cold rolling, and annealing the steel; and temper rolling the steel such that a N content [N] in a unit of mass % and a temper rolling reduction λ in a unit of % satisfy a following (Formula 2), and the temper rolling reduction λ is in a range of 5 to 10%.

$$0.050 \leq [N] \times \lambda \leq 0.100 \quad \text{(Formula 2)}$$

(5) In the method for producing the steel sheet for the bottom cover of the aerosol can according to (4), the steel may be heated at a soaking temperature of 1050° C. or higher before the hot rolling.

(6) In the method for producing the steel sheet for the bottom cover of the aerosol can according to (5), the soaking temperature may be 1100° C. or higher.

Advantageous Effects of Invention

According to the present invention, it is possible to provide a steel sheet for bottom covers of aerosol cans that is used for the bottom covers of aerosol cans having a high internal pressure, has a high strength and less stretcher-strain, and exhibits excellent workability when being attached to the can body part by seaming, and a method for producing the same.

DESCRIPTION OF EMBODIMENTS

Figure 1:
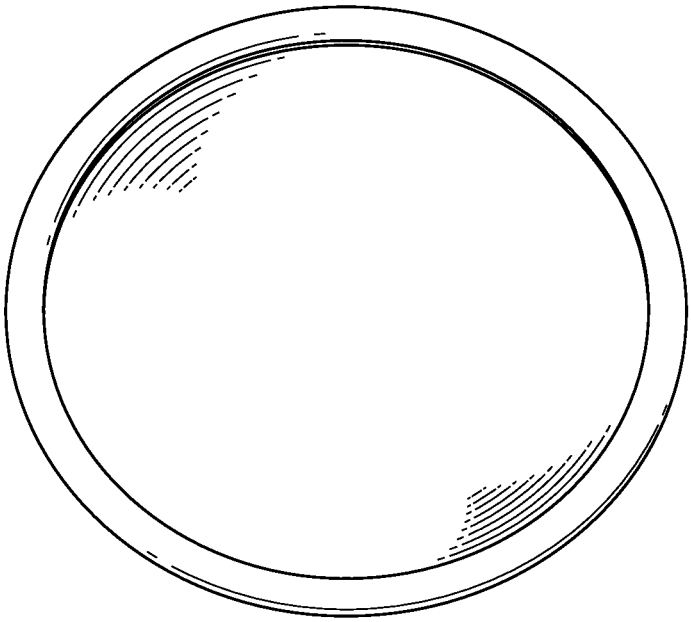
FIG. 1 is a perspective view showing an example of a steel sheet in which stretcher-strain does not occur among steel sheets molded into a bottom cover of a can.

The present inventors thought that if solid solution strengthening caused by N is balanced with work strengthening caused by TR, optimal characteristics required for a bottom cover of an aerosol can would be obtained. The present inventors also thought that if predistortion exceeding the area of non-uniform deformation in a stress-strain curve is imparted to reduce the yield point elongation ($EL_{YP}$) of the base material, occurrence of St-St would be inhibited, and the pressure resistance could be improved. A key point of the present invention is that the inventors found optimal conditions thereof.

Specifically, N is added to steel, and the obtained steel sheet is subjected to temper rolling in a range of 5 to 10% such that 0.050≤N (mass %)×temper rolling reduction≤0.100 is satisfied. Moreover, the present inventors achieved that the pressure resistance and the strength of seaming that were important for the bottom cover of the aerosol can were improved by making the solid soluted N of 0.006 mass % or more remain in the steel and by utilizing the strain aging caused when the bottom cover is subjected to press forming and attached to the can.

The steel sheet for bottom covers of aerosol cans according to the present invention contains C, Si, Mn, P, S, Al, and N in a predetermined range, and includes a balance consisting of Fe and unavoidable impurities. And a yield point (YP) in a rolling direction after aging treatment is in a range of 500±40 MPa, a total elongation in a rolling direction after aging treatment is 15% or more, a yield point elongation ($EL_{YP}$) in a rolling direction after aging treatment is 6% or less, and a sheet thickness t, the yield point YP in a rolling direction after aging treatment, and the yield point elongation $EL_{YP}$ in a rolling direction after aging treatment satisfy 130≤sheet thickness (mm)×YP (MPa)×(1−$EL_{YP}$(%)/100). Moreover, it is preferable for the steel sheet for bottom covers of aerosol cans to contain the solid soluted N of 0.004 mass % or more or 0.006 mass % or more.

Hereinafter, regarding the steel sheet for bottom covers of aerosol cans according to an embodiment of the present invention, reason for limitations of steel components and reason for limitations of mechanical characteristics such as yield point and the yield point elongation will be described.

(C: 0.025 to 0.065 Mass %)

C is an important element for securing a high strength that is important in the embodiment, and in order to secure YP of 460 MPa or higher, the C content in the steel needs to be 0.025 mass % or more. When the C content is excessive, hardening is promoted, whereby fracture during the production process, seaming failure of the bottom cover, and St-St occur. Accordingly, the upper limit of the C content is limited to 0.065 mass %. In order to further increase the strength, the C content is preferably 0.030 mass % or more and is more preferably 0.035 mass % or more. In order to further suppress the hardening, the C content is preferably 0.060 mass % or less and is more preferably 0.055 mass % or less.

(Si: 0.05 Mass % or Less)

When steel contains an excessive amount of Si, corrosion resistance deteriorates. Consequently, the upper limit of the Si content is specified to be 0.05 mass %. When an aerosol can is filled with contents particularly requiring corrosion resistance, the upper limit of the Si content is preferably specified to be 0.04 mass % and is more preferably specified to be 0.03 mass %. Si is unavoidably contained in the steel. Accordingly, the lower limit of the Si content does not need to be particularly limited, and is 0 mass %.

(Mn: 0.10 to 0.28 Mass %)

Mn bonds to S and prevents red shortness during hot rolling, so the Mn content in the steel needs to be 0.10 mass % or more. However, when an excessive amount of Mn is added to the steel, deterioration of corrosion resistance or hardening of the material is promoted. Accordingly, in the steel as a material for bottom covers of aerosol cans for which workability is considered important, the upper limit of the Mn content is 0.28 mass %. In order to further increase the strength, the Mn content is preferably 0.15 mass % or more and is more preferably 0.16 mass % or more. In order to further suppress deterioration of corrosion resistance and hardening, the Mn content is preferably 0.25 mass % or less and is more preferably 0.24 mass % or less.

(P: 0.005 to 0.03 Mass % or Less)

Deteriorating corrosion resistance, P is a harmful element which should be restricted in terms of the upper limit of the amount. Herein, since the steel is used as a steel sheet for bottom covers of aerosol cans, the upper limit of the P content is restricted to 0.03 mass %. However, since P also has an effect of hardening steel, the lower limit of the P content is 0.005 mass %. In order to further enhance corrosion resistance, the P content is preferably 0.020 mass % or less and is more preferably 0.015 mass % or less. In order to further enhance the strength, the P content is preferably 0.010 mass % or more and is more preferably 0.015 mass % or more.

(S: 0.009 Mass % or Less)

S makes steel brittle and deteriorates corrosion resistance as inclusions. Accordingly, the upper limit of the amount thereof is limited to 0.009 mass %. The lower limit of the S content does not need to be particularly limited, and is 0 mass %.

(Al: 0.01 to 0.04 Mass %)

Al is added to steel as a deoxidizer in steel manufacture. In order to obtain a sufficient deoxidizing effect, Al of 0.01 mass % or more is required. On the other hand, when an excessive amount of Al is added to the steel, the whole solid soluted N is precipitated, which makes it difficult to secure the strength of the material caused by solid solution strengthening which is important in the embodiment and to obtain strain aging. Therefore, the upper limit of the Al content is restricted to 0.04 mass %.

(N: 0.0075 to 0.013 Mass %)

For solid solution strengthening, N is positively added to steel. Here, when the N content exceeds 0.013 mass %, the effect thereof is saturated, and an excessive amount of the solid soluted N rather causes St-St. Accordingly, the upper limit of the N content is specified to be 0.013 mass %. Moreover, the lower limit of the N content is to be equal to or higher than a value that is determined from the relationship between the N content and a temper rolling reduction that will be described in the following section. In addition, considering the N content necessary for the solid solution strengthening, the lower limit of the N content needs to be 0.0075 mass % or more, is preferably 0.0080 mass % or more, and is more preferably 0.0090 mass % or more.

The above elements are base components (base elements) of the steel according to the embodiment. The chemical composition containing these base elements and a balance consisting of Fe and unavoidable impurities is the base composition of the embodiment.

(0.050≤ N Content (Mass %)×Temper Rolling Reduction (%)≤0.100)

In the embodiment, it is specified that temper rolling reduction λ is in a range of 5 to 10%, and the N content [N] in a unit of mass % and the temper rolling reduction λ in a unit of % satisfy $0.050 \leq [N] \times \lambda \leq 0.100$. This is because the balance between the N content and the temper rolling reduction on which the embodiment is based, that is, the relationship between solid solution strengthening and work strengthening changes extremely easily, so the relationship needs to be specified in detail. Even if the temper rolling reduction λ is within the range of 5 to 10%, when an excessive amount of N is added to the steel, the shape fixability or airtightness required for bottom covers of aerosol may deteriorate in some cases. The present inventors assumed that the reason was that the steel sheet was hardened since both the solid solution strengthening and work strengthening excessively occurred. The present inventors repeated the experiment and, as a result, found that only the steel, which was subjected to temper rolling such that the N content [N] (mass %) and the temper rolling reduction λ (%) satisfied $0.050 \leq [N] \times \lambda \leq 0.100$ and the temper rolling reduction λ was to be within the range of 5 to 10%, satisfied all of the pressure resistance, shape fixability, and airtightness. Also the present inventors found that, regarding the mechanical characteristics of the steel, YP in a rolling direction (for example, the longitudinal direction of the steel sheet (coil)) after aging treatment was 500±40 MPa (that is, 460 to 540 MPa), and a total elongation in a rolling direction after aging treatment was 15% or more. In addition, the present inventors found that occurrence of St-St was a slight degree in the above steel during press forming, and found that $EL_{YP}$ was suppressed to be 6% or less even though N was added to the steel by measuring $EL_{YP}$ after aging. This may be because predistortion exceeding the area of non-uniform deformation in a stress-strain curve is imparted to the steel sheet, due to the temper rolling reduction controlled to be 5 to 10%. Moreover, in order to further optimize the balance between solid solution strengthening and work strengthening, the N content [N] (mass %) and the temper rolling reduction λ (%) preferably satisfy $0.064 \leq [N] \times \lambda \leq 0.100$, and more preferably satisfy $0.072 \leq [N] \times \lambda \leq 0.100$. In addition, in order to further optimize the balance between work strengthening and total elongation, the temper rolling reduction λ (%) preferably satisfies $6 \leq \lambda \leq 10$, and more preferably satisfies $6 \leq \lambda \leq 8$.

(Solid Soluted N)

The solid soluted N has not only an effect of strengthening the steel itself, but also an effect of fixing dislocation, which is introduced at the time of the press forming for the bottom cover and seaming for attaching the bottom cover to the can body part, over several hours to several days and of further increasing the strength (strain aging) compared to the strength at the time of work. Accordingly, the amount of solid soluted N is preferably 0.004 mass % or more. When a high pressure is applied to the aerosol can, the convexity of the bottom cover starts to be deformed at a certain level of pressure (the strength at the starting point of deformation is called a buckle strength), and then the seaming portion is detached, whereby the can is burst (the strength at the time of burst is called a burst strength). However, if strain aging is utilized, both the buckle strength and burst strength can be enhanced. In order to obtain the effect, it may be necessary that the solid soluted N of at least 0.006 mass % or more is contained in the steel. Therefore, the amount of the solid soluted N is preferably 0.006 mass % or more. Even in this case, St-St can be improved by subjecting the steel sheet to TR under the temper rolling reduction of 5 to 10%. In addition, considering the N content described above, the entire N may be the solid soluted N. Accordingly, the upper limit of the amount of the solid soluted N is the same as the upper limit (for example, 0.013 mass %) of the N content.

(Yield Point (YP) in Rolling Direction after Aging Treatment: 500±40 MPa)

The yield point (YP) in a rolling direction after aging treatment is preferably in a range of 460 to 540 MPa. When YP is 460 MPa or higher, the strength is sufficient as a bottom cover of an aerosol in which an internal pressure is 16 kgf/cm$^2$ or higher. Moreover, when YP is 540 MPa or lower, the steel sheet is not excessively hardened, and it is possible to perform the press forming of the bottom cover and the seaming for attaching the bottom cover to the can body part without a problem. Accordingly, the shape fixability and airtightness of the produced aerosol are improved.

(Total Elongation in Rolling Direction after Aging Treatment: 15% or More)

The total elongation in a rolling direction after aging treatment is preferably 15% or more. When the total elongation is 15% or more, it is possible to perform seaming for attaching the bottom cover to the can body part without a problem, and accordingly, the airtightness of the produced aerosol is improved. The total elongation is more preferably 16% or more and is more preferably 20% or more. The upper limit of the total elongation does not need to be particularly limited, and may be, for example, 50%.

(Yield Point Elongation ($EL_{YP}$) in Rolling Direction after Aging Treatment: 6% or Less)

The yield point elongation ($EL_{YP}$) in a rolling direction after aging treatment is preferably 6% or less. When the yield point elongation ($EL_{YP}$) is 6% or less, occurrence of St-St is reduced, and the pressure resistance can be enhanced. Moreover, the lower limit of the yield point elongation ($EL_{YP}$) does not need to be particularly limited, and is 0%.

In the aging treatment that is performed before measuring YP, total elongation, and $EL_{YP}$ according to the embodiment, the steel sheet is heated up to 210° C. at an average heating rate of 2±1° C./s, is hold at an average temperature of 210±5° C. for 30 minutes, and is cooled to room temperature by natural cooling (air cooling). The above condition is for simulating temperature history at the time of baking for coating which is a production process of an aerosol can or of pasting a film on which a pattern has already been printed to the steel sheet. Due to the aging treatment under the condition, aging proceeds completely, and due to the completed aging, universal mechanical characteristics can be obtained (that is, the universal mechanical characteristics hardly change with the passage of time). Accordingly, if aging is completely performed on the steel sheet, the mechanical characteristics obtained after the aging treatment in the embodiment can be measured in the same manner. For example, the aging time (holding time) may be equal to or longer than a predetermined time for which the aging is proceed completely. In addition, when the aging temperature (holding temperature) is excessive high, not only the temperature of baking for coating or of pasting a film cannot be simulated, but also change in characteristics of the steel sheet that is not derived from the aging (precipitation of the solid soluted N, or the like) occurs. Therefore, the upper limit of the aging temperature (holding temperature) is preferably 250° C.

When the steel sheet for bottom covers of aerosol cans is practically used, the above aging treatment does not need to be performed intentionally, and for example, the steel sheet may be aged in a process such as baking for coating.

(Strength Parameter: 130≤Sheet Thickness (Mm)×YP (MPa)×(1−$EL_{YP}$ (%)/100))

The present invention has been made against a background of the increase in the requirement for gauge reduction with respect to a steel sheet for bottom covers of aerosol cans. When the aerosol can is practically produced, sheet thickness is generally selected from various types in consideration of minimal necessary depending on the contents or internal pressure. Since the sheet thickness greatly influences the strength, a universal strength parameter using the sheet thickness and YP is necessary. Therefore, considering not only the sheet thickness and YP but also the influence of St-St on the stress concentration as described above, the present inventors define a strength parameter which is sheet thickness (mm)× YP (MPa)×(1−$EL_{YP}$ (%)/100). In addition, as a result of trying to practically produce aerosol cans and evaluating the pressure resistance, it is confirmed that only when the strength parameter, that is, the sheet thickness t in a unit of mm, the yield point YP in a unit of MPa in a rolling direction after aging treatment, and the yield point elongation $EL_{YP}$ in a unit of % in a rolling direction after aging treatment satisfy $130 \leq t \times YP \times (1-EL_{YP}/100)$, the pressure resistance of the aerosol is to be 16 kgf/cm$^2$ or more. The upper limit of the strength parameter does not need to be particularly limited, and for example, may be 270.

The steel sheet for bottom covers of aerosol cans may have a surface treatment film such as tin plating, a chromate film, or a laminate film on the surface of the steel sheet (base material). In addition, the steel sheet for bottom covers of aerosol cans includes both the steel sheet before aging and the steel sheet after aging.

Figure 3:
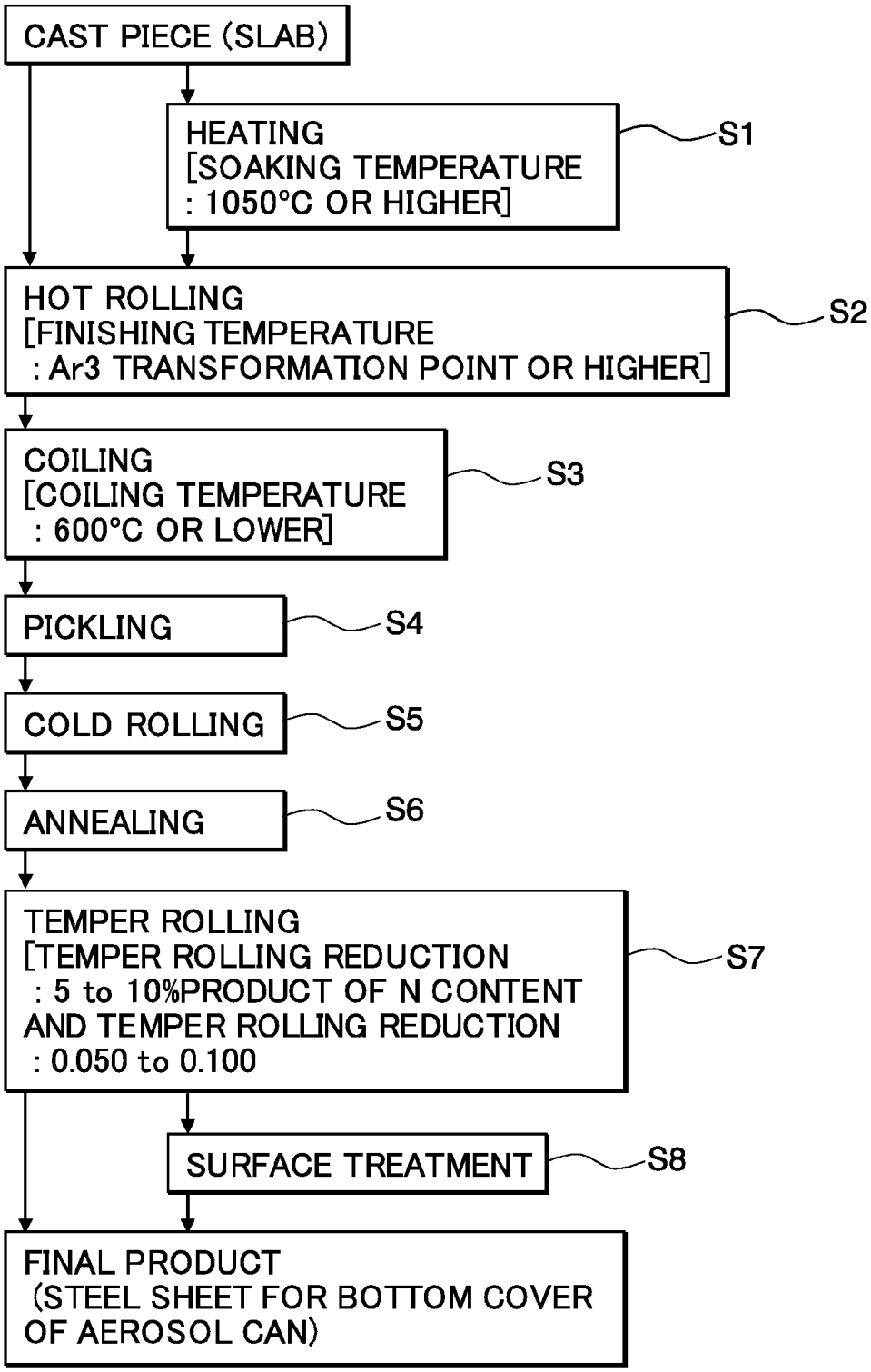
FIG. 3 is a flowchart showing an outline of the method for producing a steel sheet for bottom covers of aerosol cans according to an embodiment of the present invention.

Next, a method for producing a steel sheet for bottom covers of aerosol cans according to an embodiment of the present invention will be described. FIG. 3 shows the outline of the method for producing the steel sheet for bottom covers of aerosol cans according to the embodiment.

Molten steel (steel) having the composition (chemical composition) of the above embodiment is continuously casted to make a slab, and the slab (steel) is hot rolled to make a steel sheet (S2). When the amount of the solid soluted N is not restricted, a temperature (a taking-out temperature from a soaking furnace) of soaking conducted immediately before the hot rolling is not particularly specified. On the other hand, when the amount of the solid soluted N is increased sufficiently, the slab needs to be heated so as to secure the solid soluted N, so the temperature of soaking conducted immediately before the hot rolling is specified to be 1050° C. or higher (S1). In order to reliably increase the amount of the solid soluted N to 0.006 mass % or more, the soaking temperature is preferably 1100° C. or higher. The upper limit of the soaking temperature is not particularly specified. However, in order to prevent austenite grains from coarsening, the soaking temperature is preferably 1300° C. or lower. In order to prevent non-uniformity of the material caused by coarsening of ferrite grains, a finishing temperature needs to be controlled to a temperature equal to or higher than an Ar3 transformation point. The upper limit of the finishing temperature is not particularly limited, and may be, for example, 1000° C. or lower. Thereafter, the steel sheet (steel) after the hot rolling is coiled (S3). At this time, in order to prevent the solid soluted N from precipitating by bonding to Al in the steel, the coiling temperature needs to be controlled to 600° C. or lower. The lower limit of the coiling temperature is not particularly specified. However, in order to reduce a load of the coiling, the lower limit may be 400° C.

Subsequently, the steel sheet (steel) after the coiling is subjected to pickling (S4) and then subjected to cold rolling (S5). In the cold rolling, a rolling reduction is desirably 80% or more for homogenizing the structure, and is desirably 95% or less for reducing a load of the cold rolling mill. The rolling reduction in the present cold rolling is less than 100%.

Thereafter, the steel sheet (steel) after the cold rolling is subjected to annealing (S6). The annealing is performed for optimizing the microstructure by means of recrystallization. The condition of annealing is not restricted as long as the annealing temperature is equal to or higher than the recrystallization temperature. However, when the steel sheet is annealed at an excessive high temperature and an excessive low rate, the solid soluted N may precipitate. Accordingly, the annealing temperature is desirably 650° C. or lower. In addition, in view of securing the solid soluted N, continuous annealing is preferable, and BAF annealing (batch annealing performed by a box annealing furnace) is not preferable.

Subsequently, the steel sheet (steel) after the annealing is subjected to TR (S7). In the TR, it is necessary to control the rolling reduction (temper rolling reduction) to be 5 to 10% throughout the entire length of the product. When the rolling reduction is less than 5%, YP is insufficient, and, when the rolling reduction is more than 10%, the total elongation in a rolling direction after aging treatment is not 15% or a higher. Moreover, it is necessary to control the TR such that the N content [N] (mass %) and the temper rolling reduction λ (%) satisfy $0.050 \leq [N] \times \lambda \leq 0.100$.

In addition, surface treatment such as tin plating, chromic acid treatment, or laminating treatment may be performed on the steel sheet (steel) after the TR, in order to obtain corrosion resistance. Consequently, the products of the steel sheet for bottom covers of aerosol cans also include a surface-treated steel sheet.

When the above production conditions are satisfied, a steel sheet for bottom covers of aerosol cans in which a yield point (YP) in a rolling direction after aging treatment is in a range of 500±40 MPa, a total elongation in a rolling direction after aging treatment is 15% or more, a yield point elongation ($EL_{YP}$) in a rolling direction after aging treatment is 6% or less, and a sheet thickness t, the yield point YP in a rolling direction after aging treatment, and the yield point elongation $EL_{YP}$ in a rolling direction after aging treatment satisfy $130 \leq t \times YP \times (1-EL_{YP}/100)$ is obtained.

EXAMPLE

Steel having chemical composition which contained the chemical components shown in Table 1 and a balance consisting of Fe and unavoidable impurities was melted in a converter and made into slabs by continuous casting machine. After being heated at 1050° C. or 1230° C., the slabs were extracted (taken out) and hot-rolled at 890° C. which is a temperature equal to or higher than an Ar3 transformation point to make steel sheets having a sheet thickness of 3.0 mm, and the steel sheets were coiled at 550° C. Thereafter, pickling was performed on the steel sheets after the coiling, and then the steel sheets were cold-rolled so as to be the sheet thickness of 0.30 to 0.36 mm and subjected to continuous annealing at 650° C.

Subsequently, the coil (steel sheet) after the continuous annealing was subjected to TR under rolling reduction of 4 to 11%. In order to obtain the rolling reduction, a lubricating liquid based on synthetic ester (aqueous solution obtained by diluting Tinol 108 manufactured by Japan Quaker Chemical Corporation with pure water so as to be 0.2% solution) was used between the steel sheet and the rolling roll. The obtained coil of 0.27 to 0.34 mm was continuously treated with chromic acid, thereby tin-free steel was obtained. The above production conditions and the amount of the solid soluted N are summarized in Tables 2 and 3. Moreover, the amount of the solid soluted N was measured in the following method. Herein, almost all of the precipitate in the steel was AlN. Accordingly, the tin-free steel was dissolved in an iodine methanol solution, and the solution was filtered through a filter having a pore diameter of 0.2 μm, for example, Nuclepore filter manufactured by GE, and the extracted residue (precipitate) was collected. From the mass of the obtained extracted residue, the N content in the AlN was calculated, and from the difference between the total N content and the N content in the AlN, the amount of the solid soluted N was obtained.

The tin-free steel produced in the above process was subjected to aging treatment in which the steel was heated up to 210° C. at an average heating rate of 2±1° C./s, was hold at an average temperature of 210±5° C. for 30 minutes, and was cooled to room temperature by natural cooling (air cooling). The tin-free steel after the aging treatment was made into a JIS. No. 5 test piece and was subjected to a tensile test specified by JIS Z 2241 (1998). Moreover, cans were actually produced from the tin-free steel, and the shape fixability, pressure resistance, and airtightness thereof were evaluated. In the evaluation of shape fixability, the shape of the bottom cover after pressing was measured. When there was no difference between the shape of the bottom cover and the shape of the mold, this was evaluated to be "A", and, when there was the difference, this was evaluated to be "C".

Figure 2:
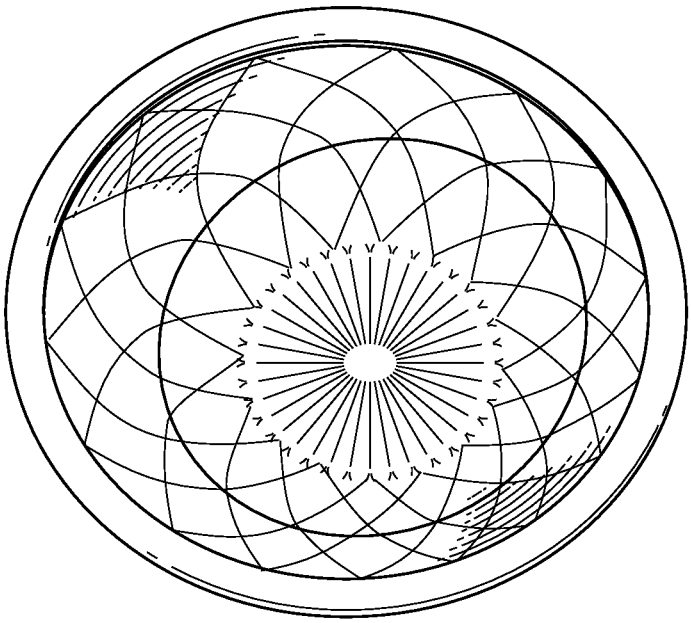
FIG. 2 is a perspective view showing an example of a steel sheet in which stretcher-strain having the shape of a flower dome occurs among steel sheets molded into a bottom cover of a can.

Regarding the pressure resistance, by using a commercially available pressure resistance tester, a pressure at the time when the can was burst was measured. Moreover, regarding the airtightness, the obtained can after forming was filled with air of 12 bar, and existence of leakage was measured. In the measurement, when there was no leakage, the airtightness was evaluated to be "A", and, when there was the leakage, this was evaluated to be "C". In addition, the pressure resistance could not be measured for cans having problem with the airtightness (cans evaluated to be "C" in terms of the airtightness). In the case, the pressure resistance was evaluated to be "unmeasurable". Regarding the St-St resistance, the surface of the bottom cover after forming was observed. When deformation caused by St-St was perceived by touch, this was evaluated to be "C". When an obvious St-St pattern was observed even though the surface seemed smooth by touch, this was evaluated to be "B". When the St-St could not be observed or a slight degree of St-St was observed, this was evaluated to be "A". FIG. 1 shows an example of the bottom cover in which St-St did not occur, FIG. 2 shows an example of the bottom cover in which St-St occurred, and Tables 4 and 5 show the results obtained in the measurements. Moreover, as described above, the strength parameter in Tables 4 and 5 indicates sheet thickness (mm)×YP(MPa)×(1−$EL_{yp}$(%)/100).

TABLE 1

| COMPOSITION No. | C (mass %) | Si (mass %) | Mn (mass %) | P (mass %) | S (mass %) | Al (mass %) | N (mass %) | Ar3 (° C.) |
|---|---|---|---|---|---|---|---|---|
| 1 | 0.035 | 0.01 | 0.20 | 0.012 | 0.008 | 0.03 | 0.0100 | 854 |
| 2 | 0.055 | 0.01 | 0.20 | 0.012 | 0.008 | 0.03 | 0.0125 | 843 |
| 3 | 0.020 | 0.01 | 0.20 | 0.012 | 0.008 | 0.03 | 0.0090 | 864 |
| 4 | 0.070 | 0.01 | 0.20 | 0.012 | 0.008 | 0.03 | 0.0140 | 834 |
| 5 | 0.040 | 0.01 | 0.20 | 0.012 | 0.008 | 0.05 | 0.0125 | 852 |
| 6 | 0.040 | 0.04 | 0.10 | 0.012 | 0.002 | 0.01 | 0.0080 | 859 |
| 7 | 0.040 | 0.04 | 0.28 | 0.012 | 0.002 | 0.01 | 0.0100 | 848 |

TABLE 2

| | COMPOSITION No. | SOAKING TEMPERATURE (° C.) | FINISHING TEMPERATURE (° C.) | COILING TEMPERATURE (° C.) | ANNEALING TEMPERATURE (° C.) | TEMPER ROLLING REDUCTION (%) | SHEET THICKNESS (mm) | N CONTENT (mass %) × TEMPER ROLLING REDUCTION (%) | AMOUNT OF SOLID SOLUTED N (mass %) |
|---|---|---|---|---|---|---|---|---|---|
| EXAMPLE 1-1 | 1 | 1050 | 890 | 550 | 650 | 5.0 | 0.30 | 0.05 | 0.004 |
| EXAMPLE 1-2 | 1 | 1050 | 890 | 550 | 650 | 10.0 | 0.28 | 0.1 | 0.004 |
| EXAMPLE 1-3 | 2 | 1050 | 890 | 550 | 650 | 5.0 | 0.34 | 0.0625 | 0.005 |
| EXAMPLE 1-4 | 6 | 1050 | 890 | 550 | 650 | 8.0 | 0.30 | 0.064 | 0.004 |
| EXAMPLE 1-5 | 7 | 1050 | 890 | 550 | 650 | 8.0 | 0.30 | 0.08 | 0.006 |
| COMPARATIVE EXAMPLE 1-1 | 2 | 1050 | 890 | 550 | 650 | 10.0 | 0.30 | 0.125 | 0.005 |
| COMPARATIVE EXAMPLE 1-2 | 3 | 1050 | 890 | 550 | 650 | 10.0 | 0.30 | 0.09 | 0.003 |
| COMPARATIVE EXAMPLE 1-3 | 4 | 1050 | 890 | 550 | 650 | 5.0 | 0.30 | 0.07 | 0.005 |
| COMPARATIVE EXAMPLE 1-4 | 5 | 1050 | 890 | 550 | 650 | 5.0 | 0.30 | 0.0625 | 0.001 |
| COMPARATIVE EXAMPLE 1-5 | 2 | 1050 | 890 | 550 | 650 | 4.0 | 0.30 | 0.05 | 0.005 |
| COMPARATIVE EXAMPLE 1-6 | 2 | 1050 | 890 | 550 | 650 | 11.0 | 0.27 | 0.1375 | 0.005 |

TABLE 3

| | COMPOSITION No. | SOAKING TEMPERATURE (° C.) | FINISHING TEMPERATURE (° C.) | COILING TEMPERATURE (° C.) | ANNEALING TEMPERATURE (° C.) | TEMPER ROLLING REDUCTION (%) | SHEET THICKNESS (mm) | N CONTENT (mass %) × TEMPER ROLLING REDUCTION (%) | AMOUNT OF SOLID SOLUTED N (mass %) |
|---|---|---|---|---|---|---|---|---|---|
| EXAMPLE 2-1 | 1 | 1230 | 890 | 550 | 650 | 5.0 | 0.30 | 0.05 | 0.008 |
| EXAMPLE 2-2 | 1 | 1230 | 890 | 550 | 650 | 10.0 | 0.28 | 0.1 | 0.008 |
| EXAMPLE 2-3 | 2 | 1230 | 890 | 550 | 650 | 5.0 | 0.32 | 0.0625 | 0.010 |
| EXAMPLE 2-4 | 6 | 1230 | 890 | 550 | 650 | 8.0 | 0.30 | 0.064 | 0.006 |
| EXAMPLE 2-5 | 7 | 1230 | 890 | 550 | 650 | 8.0 | 0.30 | 0.08 | 0.008 |
| COMPARATIVE EXAMPLE 2-1 | 2 | 1230 | 890 | 550 | 650 | 10.0 | 0.30 | 0.125 | 0.010 |
| COMPARATIVE EXAMPLE 2-2 | 3 | 1230 | 890 | 550 | 650 | 10.0 | 0.30 | 0.09 | 0.006 |
| COMPARATIVE EXAMPLE 2-3 | 4 | 1230 | 890 | 550 | 650 | 5.0 | 0.30 | 0.07 | 0.010 |
| COMPARATIVE EXAMPLE 2-4 | 5 | 1230 | 890 | 550 | 650 | 5.0 | 0.28 | 0.0625 | 0.004 |
| COMPARATIVE EXAMPLE 2-5 | 2 | 1230 | 890 | 550 | 650 | 4.0 | 0.30 | 0.05 | 0.009 |
| COMPARATIVE EXAMPLE 2-6 | 2 | 1230 | 890 | 550 | 650 | 11.0 | 0.30 | 0.1375 | 0.009 |

TABLE 4

| | YP (MPa) | TOTAL ELONGATION (%) | $EL_{YP}$ (%) | STRENGTH PARAMETER | PRESSURE RESISTANCE (kgf/cm$^2$) | SHAPE FIXABILITY | AIRTIGHTNESS | St-St RESISTANCE |
|---|---|---|---|---|---|---|---|---|
| EXAMPLE 1-1 | 472 | 22 | 3.8 | 136 | 16 | A | A | A |
| EXAMPLE 1-2 | 488 | 17 | 3.4 | 161 | 18 | A | A | A |
| EXAMPLE 1-3 | 492 | 20 | 3.8 | 142 | 18 | A | A | A |
| EXAMPLE 1-4 | 473 | 22 | 3.6 | 137 | 16 | A | A | A |
| EXAMPLE 1-5 | 478 | 21 | 3.8 | 138 | 17 | A | A | A |
| COMPARATIVE EXAMPLE 1-1 | 504 | 14 | 4.4 | 145 | UNMEASURABLE | A | C | A |
| COMPARATIVE EXAMPLE 1-2 | 448 | 22 | 4.8 | 128 | 14 | A | A | A |
| COMPARATIVE EXAMPLE 1-3 | 545 | 13 | 6.2 | 153 | UNMEASURABLE | C | C | B |
| COMPARATIVE EXAMPLE 1-4 | 446 | 24 | 3.4 | 129 | 15 | A | A | A |
| COMPARATIVE EXAMPLE 1-5 | 458 | 24 | 6.4 | 129 | 15 | A | A | B |
| COMPARATIVE EXAMPLE 1-6 | 542 | 12 | 4.4 | 140 | UNMEASURABLE | C | C | A |

TABLE 5

| | YP (MPa) | TOTAL ELONGATION (%) | $EL_{YP}$ (%) | STRENGTH PARAMETER | PRESSURE RESISTANCE (kgf/cm$^2$) | SHAPE FIXABILITY | AIRTIGHTNESS | St-St RESISTANCE |
|---|---|---|---|---|---|---|---|---|
| EXAMPLE 2-1 | 506 | 20 | 5.2 | 144 | 16 | A | A | A |
| EXAMPLE 2-2 | 520 | 17 | 4.8 | 139 | 18 | A | A | A |
| EXAMPLE 2-3 | 512 | 18 | 5.2 | 155 | 18 | A | A | A |
| EXAMPLE 2-4 | 510 | 20 | 5.2 | 145 | 18 | A | A | A |
| EXAMPLE 2-5 | 521 | 18 | 5.0 | 148 | 18 | A | A | A |
| COMPARATIVE EXAMPLE 2-1 | 534 | 12 | 5.4 | 152 | UNMEASURABLE | A | C | A |
| COMPARATIVE EXAMPLE 2-2 | 456 | 20 | 5.6 | 129 | 14 | A | A | A |
| COMPARATIVE EXAMPLE 2-3 | 550 | 12 | 6.4 | 154 | UNMEASURABLE | C | C | B |
| COMPARATIVE EXAMPLE 2-4 | 458 | 20 | 4.2 | 123 | 15 | A | A | A |
| COMPARATIVE EXAMPLE 2-5 | 456 | 20 | 8.0 | 126 | 15 | A | A | C |
| COMPARATIVE EXAMPLE 2-6 | 555 | 10 | 5.6 | 157 | UNMEASURABLE | C | C | A |

As shown in Tables 4 and 5, in all of the steel sheets of Examples 1-1 to 1-5 and 2-1 to 2-5, the pressure resistance was 16 kgf/cm$^2$ or higher, and the shape fixability, airtightness, and St-St resistance were excellent. On the other hand, in the steel sheets of Comparative examples 1-1 to 1-6 and 2-1 to 2-6, any one of the pressure resistance, shape fixability, airtightness, and St-St resistance was insufficient.

INDUSTRIAL APPLICABILITY

It is possible to provide a steel sheet for bottom covers of aerosol cans having a high internal pressure, which has a high strength and less stretcher-strain and exhibits excellent workability when being attached to the can body part by seaming.

The invention claimed is:

1. A steel sheet for a bottom cover of an aerosol can, the steel sheet consisting of, as a chemical composition, C: 0.025 to 0.065 mass %, Mn: 0.10 to 0.28 mass %, P: 0.005 to 0.03 mass %, Al: 0.01 to 0.04 mass %, N: 0.0075 to 0.010 mass %, wherein N comprises 0.004 mass % or more of solid soluted N, Si: limited to 0.05 mass % or less, S: limited to 0.009 mass % or less, and a balance consisting of Fe and unavoidable impurities, wherein:

a yield point YP in a rolling direction after an aging treatment is in a range of 460 to 540 MPa, a total elongation in the rolling direction after the aging treatment is 15% or more, a yield point elongation $EL_{yp}$ in the rolling direction after the aging treatment is 6% or less, a sheet thickness t in a unit of mm, the yield point YP in a unit of MPa in the rolling direction after the aging treatment, and the yield point elongation $EL_{yp}$ in a unit of % in the rolling direction after the aging treatment satisfy a following (Formula 1):

$$130 \leq t \times YP \times (1 - EL_{YP}/100) \quad \text{(Formula 1), and}$$

in the aging treatment, the steel sheet is heated up to 210° C. at an average heating rate of 2±1° C/s, is held at an average temperature of 210±5° C. for 30 minutes, and is cooled to a room temperature by a natural cooling.

2. The steel sheet for the bottom cover of the aerosol can according to claim 1, wherein the amount of the solid soluted N is 0.006 mass % or more.

3. The steel sheet for the bottom cover of the aerosol can according to claim 1, wherein an amount of the solid soluted N is 0.004 to 0.008 mass %.

4. The steel sheet for the bottom cover of the aerosol can according to claim 1, wherein an amount of the solid soluted N is 0.006 to 0.008 mass %.

5. The steel sheet for the bottom cover of the aerosol can according to claim 1, wherein the sheet thickness t is 0.27 to 0.34 mm.

6. The steel sheet for the bottom cover of the aerosol can according to claim 1, wherein the yield point YP in a unit of MPa in the rolling direction after the aging treatment is in a range of 460 to 492 MPa.

7. A method for producing the steel sheet for the bottom cover of the aerosol can according to claim 1 or claim 2, the method comprising:

hot rolling a steel consisting of, as a chemical composition,

C: 0.025 to 0.065 mass %,

Mn: 0.10 to 0.28 mass %,

P: 0.005 to 0.03 mass %,

Al: 0.01 to 0.04 mass %,

N: 0.0075 to 0.010 mass %, wherein N comprises 0.004 mass % or more of solid soluted N, Si: limited to 0.05 mass % or less, S: limited to 0.009 mass % or less, and a balance consisting of Fe and unavoidable impurities, at a finishing temperature equal to or higher than an Ar3 transformation point;

coiling the steel at a temperature equal to or lower than 600° C.;

pickling, cold rolling, and annealing the steel; and temper rolling the steel such that a N content [N] in a unit of mass % and a temper rolling reduction λ in a unit of % satisfy a following (Formula 2), and the temper rolling reduction λ is in a range of 5 to 10%:

$$0.050 \leq [N] \times \lambda \leq 0.100 \quad \text{(Formula 2).}$$

8. The method for producing the steel sheet for the bottom cover of the aerosol can according to claim 7, wherein the steel is heated at a soaking temperature of 1050° C. or higher before the hot rolling.

9. The method for producing the steel sheet for the bottom cover of the aerosol can according to claim 8, wherein the soaking temperature is 1100° C. or higher.

10. The method for producing the steel sheet for the bottom cover of the aerosol can according to claim 7, wherein the temper rolling reduction λ is in a range of 5 to 8%.

11. The method for producing the steel sheet for the bottom cover of the aerosol can according to claim 7, wherein, when the steel is annealed, an annealing temperature is 650° C. or less.

* * * * *